United States Patent [19]

Barker

[11] Patent Number: 4,930,290

[45] Date of Patent: Jun. 5, 1990

[54] CARTON PACKAGING SYSTEMS AND PROCESSES

[75] Inventor: Michael J. Barker, Tring, United Kingdom

[73] Assignee: Omnitech (Europe) Limited, Bucks, England

[21] Appl. No.: 276,867

[22] Filed: Nov. 28, 1988

[30] Foreign Application Priority Data

Nov. 30, 1987 [GB] United Kingdom ..... 8727938

[51] Int. Cl.[5] ..... B65B 11/18

[52] U.S. Cl. ..... 53/456; 53/207; 53/462

[58] Field of Search ..... 53/462, 466, 461, 207, 53/209, 228, 230, 220, 456, 458

[56] References Cited

U.S. PATENT DOCUMENTS

| | | | |
|---|---|---|---|
| 3,374,603 | 3/1968 | Miller et al. | 53/207 X |
| 3,530,640 | 9/1970 | Hoffmann | 53/207 X |
| 3,964,239 | 6/1976 | Elford | 53/207 X |
| 4,085,564 | 4/1978 | Focke | 53/207 X |
| 4,463,541 | 8/1984 | Nowacki | 53/462 X |

FOREIGN PATENT DOCUMENTS 0230137 12/1986 European Pat. Off. .

*Primary Examiner*—James F. Coan

*Attorney, Agent, or Firm*—Weingarten, Schurgin, Gagnebin & Hayes

[57] ABSTRACT

This invention relates to apparatus comprising carton-forming means (12) and product-loading means (6, 15, 15'), and means to synchronize the carton forming and product loading such that each carton is formed and loaded before each successive carton is formed and loaded. There is preferably a common station for the carton-forming means and the product-loading means. The former (12) is a hollow member having a first opening (11*a*) in one wall for admitting articles to the interior and a second opening (11*b*) in another wall for permitting the escape of the content. The exterior of the hollow member cooperates with a forming passage (14) of geometrically similar cross section, disposed beneath a product-loading position (*P*1).

24 Claims, 6 Drawing Sheets

CARTON PACKAGING SYSTEMS AND PROCESSES

Figure 1:
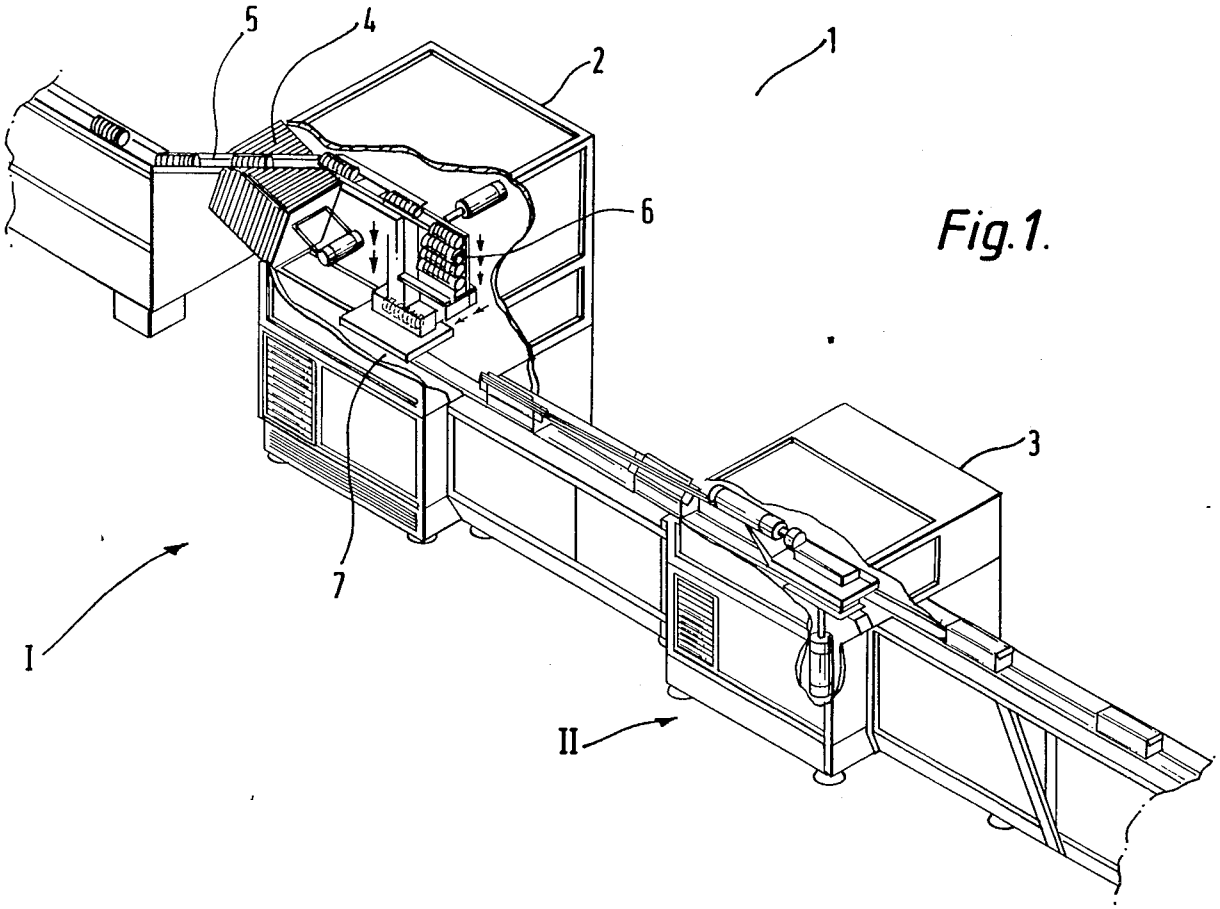

This invention relates to systems and processes in which articles, especially pre-wrapped articles, such as food products, are packed into cartons. One or more articles may be packed into each carton; each article may be a pre-wrapped batch of individual articles which may be, although not necessarily, of identical shape and size. The content of a carton is referred to herein as "product".

Cartons are generally made of rigid, semi-rigid or tough other formable material, typically card, and are employed to provide an outer vehicle for protection especially during transport and sale. Also cartons are usually externally printed with information concerning the product and its source, and with decorative matter to attract the customer.

Conventional cartoning machines are expensive and cumbersome and have poor adaptability as regards different sizes and numbers of articles to be cartoned in each carton. Two such conventional systems are now described.

In one conventional cartoning system a carton blank is made from card by die-punching to provide an appropriate arrangement of contiguous foldable panels and flaps and given a supply of glue down at least one of the two longitudinal free edges. The longitudinal free edges of the blank are then pressed together and the so-formed sleeve is folded flat along a central longitudinal fold. Collapsed sleeves are supplied from a magazine subsequently downstream and expanded and one of the open ends of the sleeve is lined up with a product to be cartoned which is pushed inside. This is generally known as "end-loading". The ends of the sleeve are then closed and sealed.

In another known cartoning system a carton sleeve is similarly punched into card but is not glued and collapsed. Instead the sleeve is formed into a box-shape, with a base, four sides and an open lid, and then discharged for subsequently receiving its contents through the space provided by the open lid, which is then closed and sealed. This is generally known as "top-loading". Both these systems require a relatively large number of parts to be changed over when changing one or both of the sizes and numbers of products to be wrapped.

Thus, it is an object of the invention to overcome these problems. It is also an object of the invention to provide a carton-packaging system and process which can be employed to carton products from a high speed, automatic wrapping system, especially such a wrapping system including batch wrapping apparatus.

According to the invention there is provided carton-packaging apparatus comprising carton-forming means and product-loading means, and means to synchronise the carton forming and product loading such that each carton is formed and loaded before each successive carton is formed and loaded.

According to another aspect of the invention there is therefore provided a carton-packaging process comprising carton forming and product loading, wherein each carton is formed and loaded before each sucessive carton is formed and loaded.

The invention enables the cartoning of each product to be precisely controlled and both rapidly and effectively carried out. Advantageously the product-loading means comprises means to load product onto a portion of a carton blank and the product-loading means is disposed with or upstream of the carton-forming means. Thus, also advantageously the product-loading step comprises loading a product onto a portion of a carton blank and the product-loading step is carried out prior to or with the carton-forming step. This allows full control of the cartoning procedure.

It is preferred, that there is a common station for the carton-forming means and the product-loading means for total synchronisation of the carton-forming and product-loading. Thus, the product loading may be carried out immediately before, during, or immediately after the carton-forming step on that carton which is about to be, which is being, or which has just been loaded.

In an advantageous arrangement the former comprises a reciprocable hollow carton former member having an opening in one wall for admitting articles to the interior and an opening in the base for liberating the content of the carton-former. The former member may be ram-controlled from above and the admission opening may be in one side of the former member. Preferably articles are supplied by loading apparatus including a verticle through-passage.

It is also preferred that the former further comprises a forming passage beneath the product load position so that a carton may be formed immediately after or before or while product loading.

Thus a product may be loaded into the former-member in an upper position of the former member so that it lies on a panel of the carton blank and then the former member may be moved downwardly within the forming passage to form a carton around the product. It is therefore preferred that the product-loading is carried out in vertical relation to the carton-forming and especially the product loading is carried out vertically above the carton-forming.

Articles given an outer protective carton in this way are produced rapidly and effectively and this can be precisely controlled electronically. The carton-packing system and process can be employed as part of a high speed, automatic, continuous packaging system. Cost savings are obtained by using unsealed carton blanks.

The combined carton-forming and product-load station affords great versatility and convenience and simplified the machinery of the system, which can gain results in cost savings. Also, there are few parts to change if the size or number of products is to be altered, which results in a considerable saving of time.

In particular the only parts requiring replacement are the former and the forming passageways. The rest of the system can be adjusted accordingly.

Figure 2A:
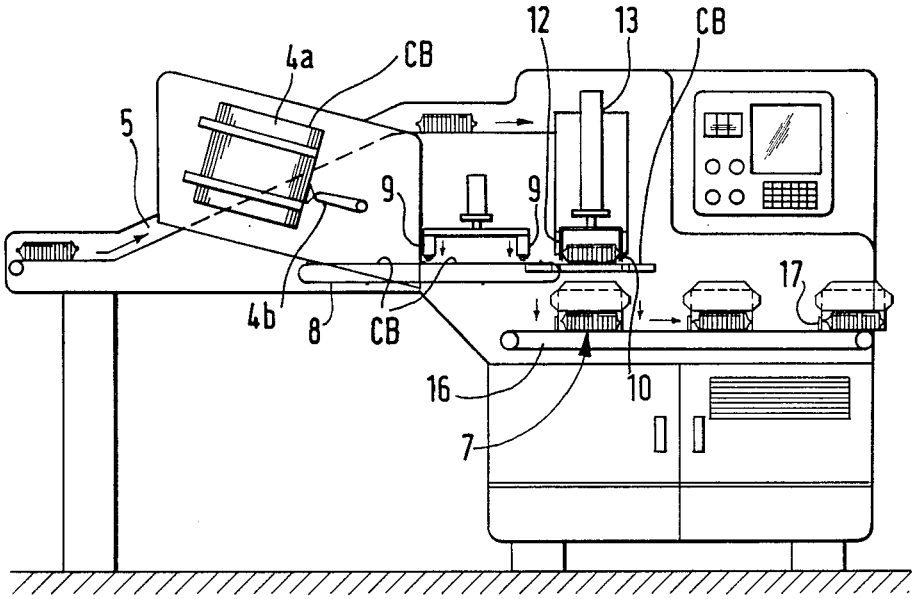
Figure 2B:
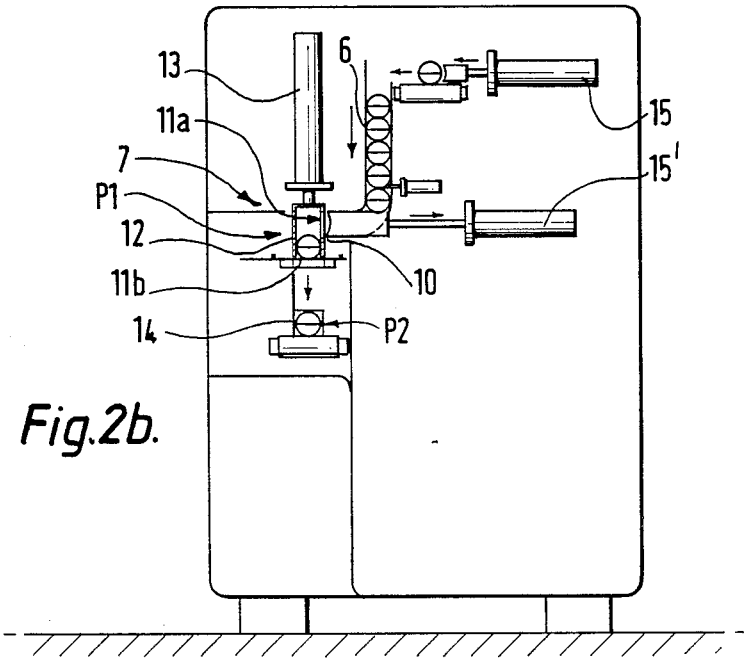
Figure 2C:
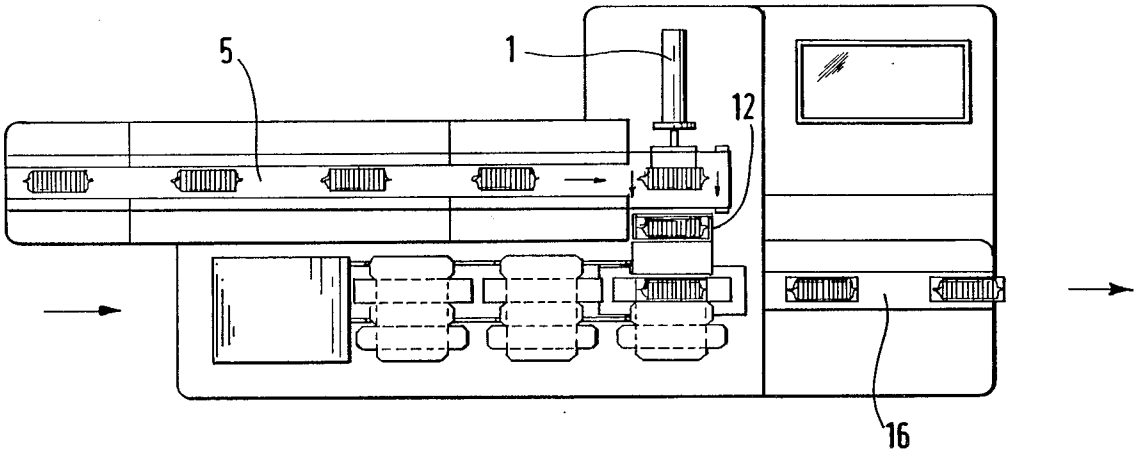
Figure 3A:
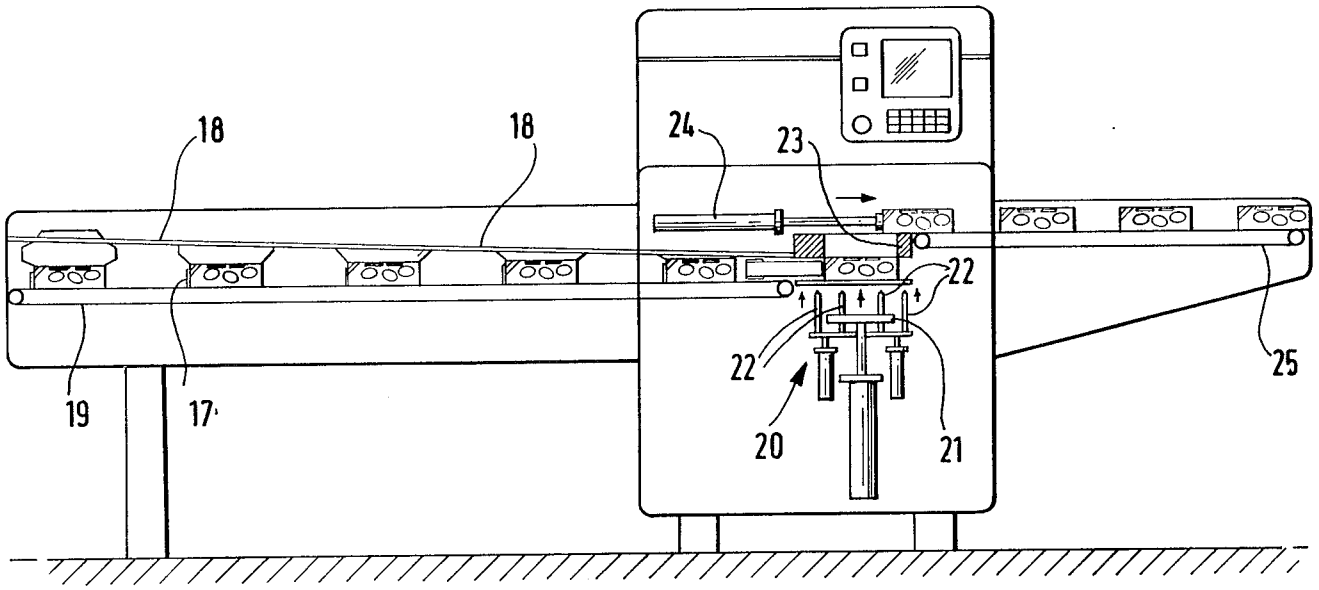
Figure 3B:
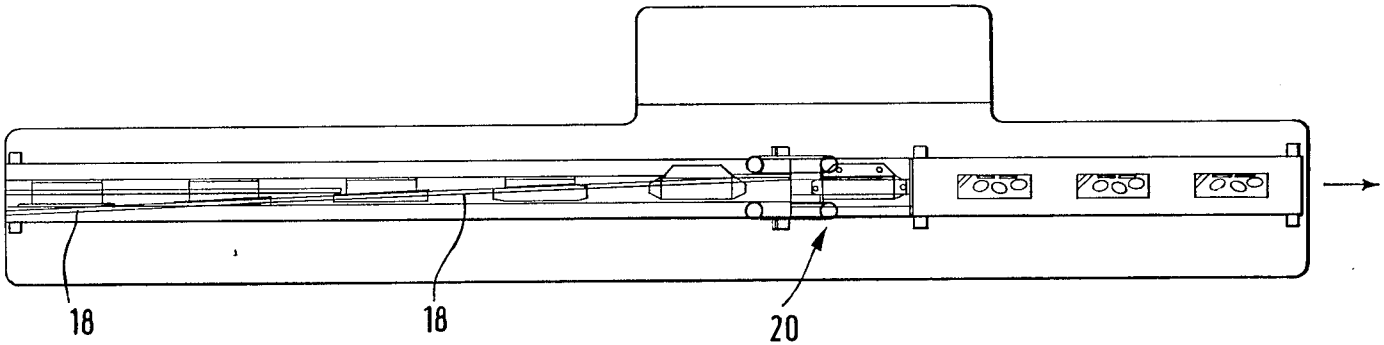
Figure 4:
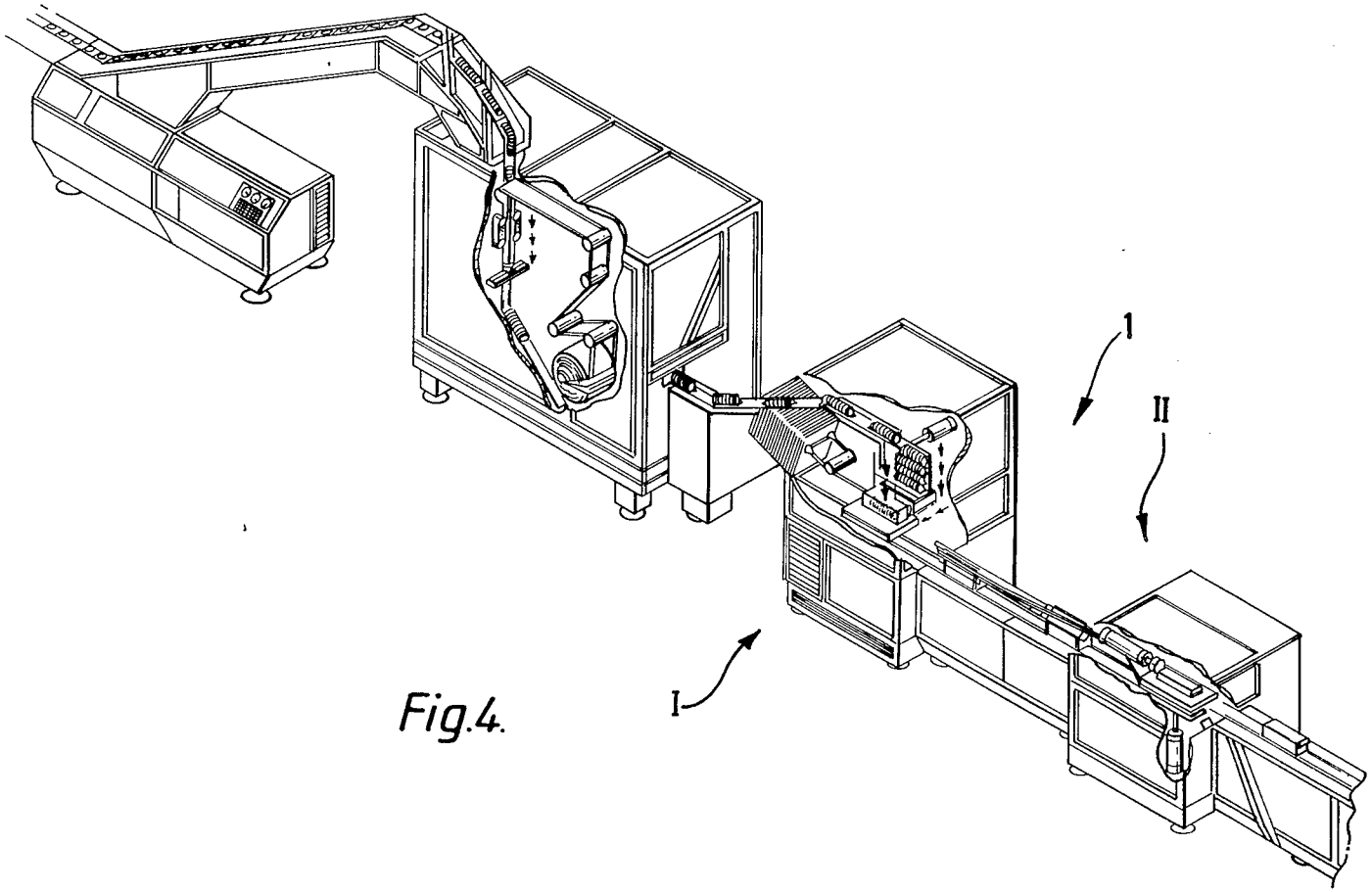

A preferred embodiment of a carton-packaging system and process according to the invention will now be described by way of example, with reference to the drawings, in which:

FIG. 1 shows a carton-packaging system, comprising stage I in which product is loaded and carton is formed and stage II, in which the carton is closed;

FIGS. 2*a*, 2*b* and 2*c* show stage I of the system in more detail, in which FIG. 2*a* is a side view, 2*b* is an end view and 2*c* is a plan view;

FIGS. 3*a* and 3*b* show stage II of the system in more detail, in which FIG. 3*a* is a side view and 3*b* is a plan view;

FIG. 4 shows the carton-packaging system as part of a continuous packaging system, in-line with the preceding stage, a primary wrapping station.

A carton packaging system 1 consists of a stage I module 2 followed by a stage II module 3. The operation of the two stages is monitored and optimised by a central processing unit (not shown).

The stage I module 2 has a magazine 4 for storing flat carton blanks CB having a preselected arrangement of panels, folds, and flaps to form a certain carton shape. An uphill flat bed conveyor 5 leads to the top of an L-shaped loading 6 next to a carton-forming and product insertion station 7 while a horizontal flat bed conveyor 8 having regularly-spaced pusher flights leads from the carton magazine 4*a*, which is associated with a sucker arm 4*b*, past a glue application station 9, as shown in FIG. 2*a*, to a product insertion position 10 constituted by the downward end of the L-shaped loading passage 6 and an opening 11*a* in the side of a carton former member 12 (see FIG. 2*b*). The former member consists of four sides and is elongate. It also has an opening 11*b* in its base to allow product to pass through during forming of a carton from the blank therebelow.

The carton former member 12 is vertically reciprocable by means of a ram 13 acting from above and moves from a retracted uppermost position (not shown) through an upper position P1 to a lower position P2 (as shown in FIG. 2*b*) through a vertical former passageway 14, which has a slightly larger but geometricably similar cross section to the former member 12. Rams 15, 15' are provided respectively at the top and bottom of the vertical limb of the loading passage 6 for moving products. Below the former passage 14 a take-off horizontal, flat bed conveyor 16 is provided, including regularly spaced flights 17 for acting on the trailing edge of cartons, for removing filled cartons and transporting them to the stage II module 3 for closure and sealing of the carton. The Stage II module 3 has an elongate, downward lid closing rail 18 above an infeed, horizontal flat bed conveyor 19, again including regularly spaced flights 17. This infeed conveyor 19 leads to a carton closure and seal station 20 which consists of elevator rams 21 for glue applicators 22 for the end flaps of the cartons and for cartoned product and an upwardly-extending second former passage 23 in which the end flaps of each carton are folded and stuck by pressure.

At the upper end of the second former passage 23 downstream-acting ram means 24 is employed to push cartoned product onto a discharge conveyor 25, which takes the usual form. Products are conveyed to a case packing station (not shown).

The operation of the carton packaging system will now be described with reference to a single carton and its product. The system of this embodiment is especially adapted for cartoning pre-wrapped articles of for instance biscuits or similar.

The lowermost carton blank is conveyed from the magazine 4*a* by the suction arm 4*b* onto the horizontal conveyor past the glue application station 9, which applies glue at preselected places on the carton blank, to the carton-forming and product insertion station 7. While the former member 12 is in a retracted position, the carton blank assumes a position beneath the former member 12 with one panel confronting the member, which will be the base of the carton throughout the cartoning system.

According to the invention: (1) the former member 12 is lowered by its ram 13 into the product insertion position P1, in which (2) the lower ram 15' of the loading apparatus pushes the required number of articles through the side opening 11*a* of the former into the former one above the other. (3) The former member 12 then descends taking with it the carton blank therebeneath. (4) The former member 12 and the complementarily-shaped passageway co-operate to form the carton shape. A filled carton emerges from the lower end of the passageway once the former memebr 12 has been raised from its lower position P2.

The cartoned product is then removed on the take-off conveyor 16 and passed from this onto the infeed conveyor 19 of the stage II module.

These steps (1) to (4) are synchronised such that each individual carton is formed and loaded in the carton-forming and product-loading station 7 and these steps are repeated for each carton being processed. Thus the forming and loading are carried out in conjunction with one another on the same carton.

In this module the lid of the carton is closed by the rail 18 while the carton is passed downstream. Glue is applied at the closure and seal station 20 to the end flaps of the carton and the carton is raised through the second former passageway in order to close and seal the end flaps. The cartoned product is then sent off for packing in a case for transportation.

This system is especially useful for cartoning batched products produced by a system as described and claimed in our co-pending British patent application No. 8727117 the contents of which are herein wholly incorporated by reference. All the stages of the carton-packaging system and process are advantageously continually monitored, synchronised and regulated by a central processing unit, in accordance with the modular principle described and claimed in our European patent application published under No. 0230137A1 the contents of which are herein wholly incorporated by reference.

I claim:

1. A modular carton-packaging apparatus comprising a modular carton-forming means, a modular product-loading means, and means to synchronize the carton forming and product loading such that each carton is formed and loaded before each successive carton is formed and loaded, the modular product-loading means comprising chute means to load product onto a portion of a carton blank, the chute means including a first leg for receiving a product in one plane and a second leg for directing the product onto another plane in which the carton blank is disposed.

2. Apparatus according to claim 1, wherein the modular product-loading means is disposed with or upstream of the carton-forming means.

3. Apparatus according to claim 1, wherein the modular carton-forming means and the modular product-loading means are disposed at the same station.

4. Apparatus according to claim 3, wherein the first and second legs of the chute means constitute an "L"-shaped duct with the second leg serving to direct a product onto a lower plane than the plane of the first leg.

5. Apparatus according to claim 4, wherein the carton-forming means comprises a hollow former member having a first opening in one wall for admitting articles to the interior and a second opening in another wall for permitting the escape of the content of the former member.

6. Apparatus according to claim 5, wherein the first opening is in a side wall of the former member and the second opening is in the base wall of the former member.

7. Apparatus according to claim 5, wherein the former further comprises a forming passage beneath the product-loading position.

8. Apparatus according to claim 4, wherein the product-loading passage includes a vertical portion.

9. Apparatus according to claim 2, having a common station for the carton-forming means and the product-loading means.

10. Apparatus according to claim 9, wherein the product-loading means comprises a loading passage leading to a product-loading position.

11. Apparatus according to claim 6, wherein the former further comprises a forming passage beneath the product-loading position.

12. Apparatus according to claim 5, wherein the product-loading passage includes a vertical portion.

13. Apparatus according to claim 6, wherein the product-loading passage includes a vertical portion.

14. Apparatus according to claim 7, wherein the product-loading passage includes a vertical portion.

15. Apparatus according to claim 11, wherein the product-loading passage includes a vertical portion.

16. A carton-packaging process comprising carton-forming and product-loading, wherein each carton is formed and loaded before each successive carton is formed and loaded, and wherein during product-loading, product is received in a chute means in a first leg in one plane and directed in said chute means in a second leg onto another plane in which a carton blank to be loaded is disposed.

17. A process according to claim 16, wherein the product-loading step comprises loading a product onto a portion of a carton blank and the product loading step is carried out in a time period from prior to until concurrent with the carton-forming step.

18. A process according to claim 9, wherein the product-loading is carried out in a time interval from immediately before until immediately after the carton-forming step on that carton being loaded.

19. A process according to claim 16, wherein the product-loading is carried out in vertical relation to the carton-forming.

20. A process according to claim 12, wherein the product loading is carried out vertically above the carton-forming.

21. A process according to claim 10, wherein the product-loading is carried out in a time interval from immediately before until immediately after the carton-forming step on that carton being loaded.

22. A process according to claim 10, wherein the product-loading is carried out in vertical relation to the carton-forming.

23. A process according to claim 11, wherein the product-loading is carried out in vertical relation to the carton-forming.

24. A process according to claim 21, wherein the product-loading is carried out in the vertical relation to the carton-forming.

* * * * *